United States Patent [19]

Ferraro

[11] 3,964,159

[45] June 22, 1976

[54] ADJUSTABLE SAFETY RAZOR

[75] Inventor: Frank A. Ferraro, Trumbull, Conn.

[73] Assignee: Warner-Lambert Company, Morris Plains, N.J.

[22] Filed: Nov. 22, 1974

[21] Appl. No.: 526,080

Related U.S. Application Data

[63] Continuation-in-part of Ser. No. 466,600, May 3, 1974, abandoned.

[52] U.S. Cl. ..... 30/47; 30/50

[51] Int. Cl.[2] ..... B26B 21/06

[58] Field of Search ..... 30/38, 47, 50, 54, 57, 30/60, 60.5, 61, 63, 68, 69, 71, 77; 403/33, 81

[56] References Cited

UNITED STATES PATENTS

| | | | |
|---|---|---|---|
| 3,375,578 | 4/1968 | Nissen | 30/63 X |
| 3,816,916 | 6/1974 | Kuhnl | 30/63 X |

FOREIGN PATENTS OR APPLICATIONS

| | | | |
|---|---|---|---|
| 18,652 | 12/1913 | United Kingdom | 30/71 |
| 146,052 | 7/1920 | United Kingdom | 30/57 |
| 231,732 | 4/1925 | United Kingdom | 30/57 |

*Primary Examiner*—Al Lawrence Smith
*Assistant Examiner*—Gary L. Smith
*Attorney, Agent, or Firm*—Albert H. Graddis; Jeremiah J. Duggan

[57] ABSTRACT

A specific embodiment provides an adjustable safety razor comprising a guard structure hinged to a blade seat, and a manually operable slide. A recess and a rail slidably interconnect the slide member and the blade seat for guiding the slide member in a direction parallel to an axis defined by the hinging structure. Another recess and rail slidably interconnect the slide member and the guard structure in an angular direction with respect to the axis of the hinging structure for moving the guard structure about the axis of the hinging structure upon manual operation of the slide member.

12 Claims, 5 Drawing Figures

ADJUSTABLE SAFETY RAZOR

CROSS-REFERENCE TO RELATED APPLICATION

This application is a continuation-in-part of copending U.S. patent application Ser. No. 466,600, filed May 3, 1974, now abandoned.

BACKGROUND OF THE INVENTION

The present invention relates to safety razors of the type in which a guard structure is manually adjustable to vary the shaving parameters of the razor. The invention is particularly suitable for safety razors of the type having at least one blade permanently bonded in a replaceable plastic cartridge, or of the disposable type formed at least in-part of plastic.

Safety razors having means for adjusting guard structure with respect to blade cutting edge(s) are well known in the art. For example, U.S. Pat. No. 3,375,578 discloses an adjustable band razor cartridge, U.s. Pat. No. 3,358,368 provides an adjustable double edge razor and U.S. Pat. No. 3,203,093 shows an adjustable single edge razor. Movement of the guard structure acts to vary shaving parameters such as shave or tangent angle, exposure and span. Shave angle is measured between the median plane of a blade and a plane extending from the cutting edge of the blade tangent to the skin-engaging surfaces in front of the blade. Exposure is the distance from the cutting edge to a plane tangent to skin-engaging surfaces disposed in front of and behind the cutting edge. Span is the distance between the cutting edge and the skin-engaging surface in front of the cutting edge.

SUMMARY OF THE INVENTION

An object of the present invention is to provide a relatively uncomplex means for adjusting a guard structure with respect to blade cutting edge(s), such that manufacturing and assembly costs are minimized.

In accordance with the present invention there is provided an adjustable safety razor comprising means for hinging a guard structure to a blade seat member, and a manually operable slide. Means slidably interconnect the slide member and the blade seat member for guiding the slide member in a direction parallel to an axis defined by the hinging means. Means slidably interconnect the slide member and the guard structure in an angular direction with respect to the axis of the hinging means for moving the guard structure about the hinging means upon manual operation of the slide member. Alternatively, the guiding means can interconnect the slide member and the guard structure, and the moving means can interconnect the slide member and the blade seat member.

DESCRIPTION OF SPECIFIC EMBODIMENTS

The specific embodiment shown in the Figures is a replaceable twin blade cartridge 10 of the type disclosed in U.s. Pat. Nos. 3,783,510 and 3,785,051, and in pending U.S. patent application Ser. No. 433,030, filed Jan. 14, 1974, by F. A. Ferraro for Razor Blade Cartridge and assigned to the assignee of the present application. U.s. Pat. Nos. 3,783,510 and 3,785,015, and patent application Ser. No. 433,030, filed Jan. 14, 1974 are incorporated herein by reference.

Figure 1:
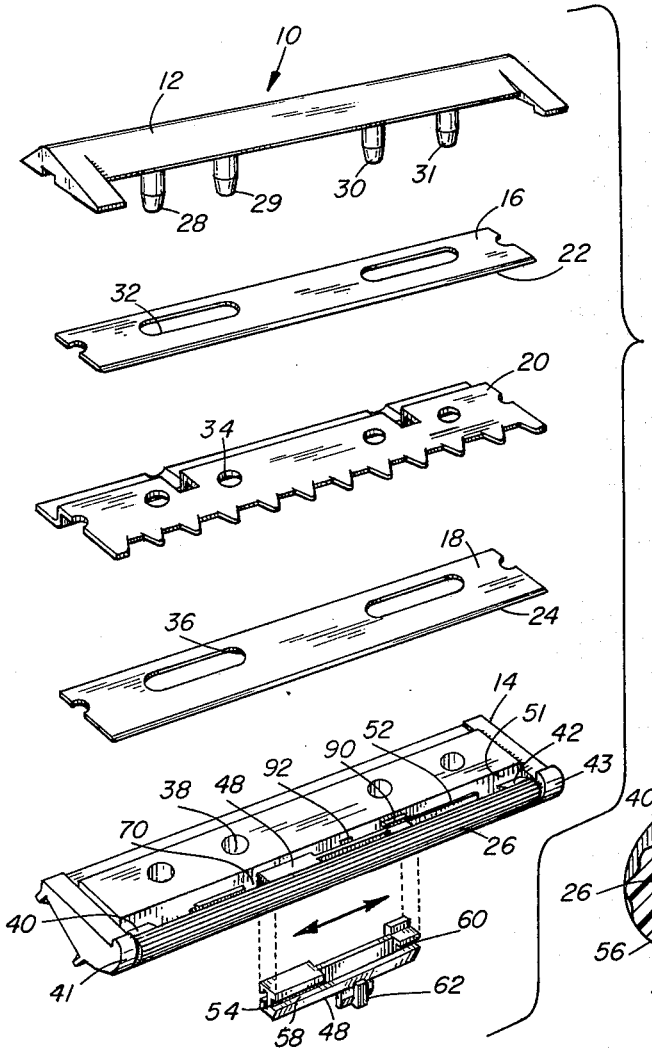
FIG. 1 is an exploded perspective view of a twin blade cartridge embodiment of the present invention.
Figure 2:
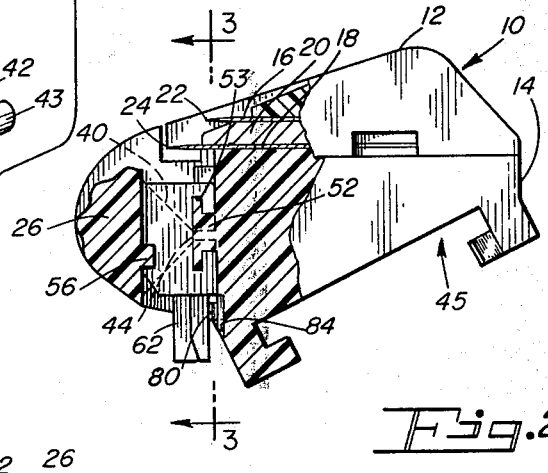
FIG. 2 is a cross-sectional view of the cartridge taken along line 2—2 of FIG. 3.
Figure 3:
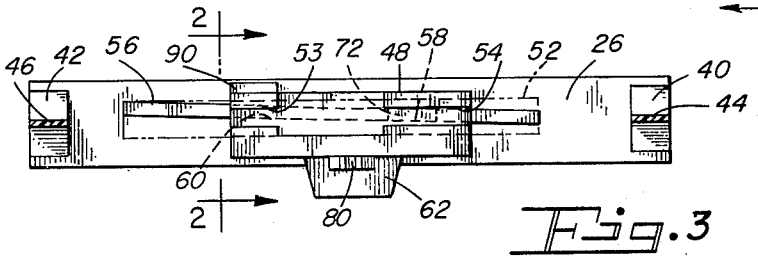
FIG. 3 is a view of the rear side of a guard structure and a slide taken along ine 3—3 of FIG. 2.

With reference to FIGS. 1 to 3, the cartridge 10 includes a plastic cap member 12 and a plastic blade seat member 14. A pair of single cutting edge blades 16, 18 vertically separated by a spacer member 20 are permanently bonded between the cap member 12 and the blade seat member 14. As shown in FIG. 2, the cutting edges 22, 24 are tandemly arranged with respect to a guard structure 26.

The cap member 12 has two pairs of downwardly extending posts 28, 29; 30, 31. The posts 28–31 extend through a pair of slots 32 in the top blade 16, respective holes 34 in the spacer member 20, a pair of slots 36 in the bottom blade 18, and respective holes 38 in the blade seat member 14. The lower ends of the posts 28-31 are deformed (not shown) to prevent removal of the posts through the blade seat holes 38 and thereby bond the components of the cartridge 10 together. The posts 28-31, the slots 32; 36 and the holes 34; 38 can be dimensioned and/or shaped to provide an interference fit and the cartridge components can be assembled as taught by patent application Ser. No. 433,030 filed Jan. 14, 1974.

As shown in FIG. 2, the cartridge 10 has a T-shaped channel 45 formed on a lower side of the blade seat member 14 for sliding engagement with transverse supporting surfaces on a holder (not shown). A suitable holder for the cartridge 10, is shown in U.S. Pat. No. 3,783,510. U.S. Pat. Nos. 3,783,510 and 3,785,051 disclose systems suitable for dispensing a plurality of the cartridges 10.

The guard structure 26 is spaced a slight distance from the forward outer blade seat corners 41, 43 and is hinged to a forward wall 51 of the blade seat member 14 by spaced webs 40, 42. The guard structure 26 and the webs 40, 42 are molded integrally with the blade seat member 14, and the ribs 40, 42 have reduced cross-section portions 44, 46 at the forward blade seat wall 51. The reduced cross-section portions 44, 46 define a transverse hinging axis parallel to the guard structure 26, and the guard structure 26 is movable about the hinging axis.

A plastic slide member 48 is positioned between the guard structure 26 and the forward blade seat wall 51. Spaced grooves, 53, 54 form a recess along the rear surface of the slide member 48 for seating therein a transverse rail 52 formed on the forward blade seat wall 51. As shown in FIG. 2, the recess 53, 54 is T-shaped for sliding engagement with the rail 52. The recess 53, 54 and the rail 52 are parallel to the hinging axis 44, 46 and to the guard structure 26.

A pair of spaced grooves 58, 60 form a recess on the front of the slide member 48 for seating therein a linear rail 56 formed on the rear of the guard structure 26. As viewed in FIG. 2, the recess 58, 60 and the guard structure rail 56 define a vertical plane which is parallel to a vertical plane defined by the recess 53, 54 and the blade seat rail 52. However, as shown in FIGS. 1 and 3, the recess 58, 60 and the guard structure rail 56 are angularly positioned with respect to the hinging axis 44, 46 and to the guard structure 26.

The slide member 48 has a finger-engageable portion 62. With reference to FIG. 3, the recess 53, 54 and the rail 52 (shown in dashed lines) slidably interconnecting the slide member 48 and the blade seat member 14 guide the slide member 48 in a direction parallel to the hinging axis 44, 46 upon manually induced transverse movement of the slide member 48. Since the recess 58, 60 and the rail 56 slidably interconnecting the guard structure 26 and the slide member 48 are at an angle with respect to the hinging axis 44, 46, such transverse manual operation of the slide member 48 acts to move the guard structure 26 about the hinging axis 44, 46 to adjust the guard structure 26 with respect the cutting edges 22, 24.

Specifically, operation of the slide member 48 to the left as viewed in FIG. 3 will pivot the guard structure 26 downwardly about the hinging axis 44, 46. Conversely, movement of the slide member 48 to the right as viewed in FIG. 3 will cause the guard structure 26 to pivot upwardly about the hinging axis 44, 46.

The rear surface of the slide 48 can have a notch 80 (FIG. 3) for snap-lock engagement with one of three protrusions 82, 83, 84 formed on the forward blade seat wall 51 to define three discrete positions of the guard structure 26 with respect to the cutting edges 22, 24.

The slide member 48 is initially fitted upwardly between the guard structure 26 and the blade seat member 14 to the extreme left as viewed in FIG. 1. The right hand portion of the slide forming the grooves 60, 53 passes upwardly through breaks 70 in the rails 52, 56. Thereafter, the slide 48 is moved to the right to seat the recesses 58, 60; 53, 54 on the rails 52, 56. As the slide is moved to the right an upwardly extending portion 90 is forced over a wedge-shaped ramp 92 on the blade seat wall 51. When the slide portion 90 is to the right of the ramp 92, further abutting engagement by the slide portion 90 with the ramp 92 will restrict or limit movement of the slide 48 to the left. The blade seat wall 51 also has a stop 94 (FIG. 4) for limiting movement of the slide 48 to the right.

Figure 4:
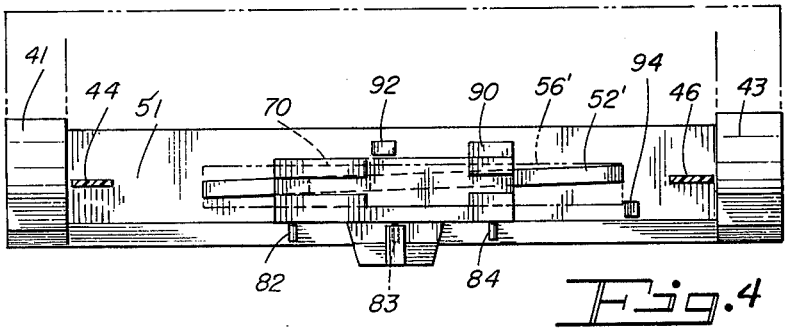
FIG. 4 is a front elevational view of another embodiment of the present invention with the guard bar cutaway.
Figure 5:
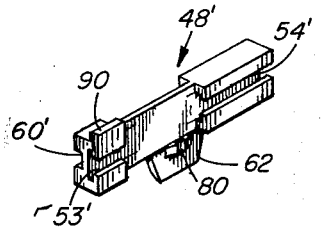
FIG. 5 is a perspective view of the rear side of a slide used in the embodiment of FIG. 4.

It is apparent that the rails can alternatively be formed on the slide member, and that the grooves or recesses can be formed in the guard structure and blade seat member. Further, as shown in FIGS. 4 and 5, the angled rail 52' and recess 53', 54' can alternatively interconnect the slide member and the blade seat member, with the parallel guide rail 56' and recess 58', 60' interconnecting the guard structure and the slide member.

It is also apparent that the present invention is suitable for use on disposable razors such as that disclosed in U.S. Pat. No. 3,703,765. The present invention also contemplates adjustment of single and double edge razors such as shown in U.S. Pat. Nos. 3,203,093 and 3,358,368, respectively.

What is claimed is:

1. An adjustable safety razor comprising:

a. a blade seat member, b. at least one blade positioned on said blade seat member, said at least one blade comprising at least one cutting edge, c. an elongated guard structure parallelly spaced forwardly of said at least one cutting edge, d. means for hinging said guard structure to said blade seat member, said hinging means defining an axis parallel to said guard structure, e. a manually operable slide member, f. means slidably interconnecting said slide member and said blade seat member for guiding said slide member in a direction parallel to said axis, and g. means slidably interconnecting said slide member and said guard structure in an angular direction with respect to said axis for moving said guard structure about said axis to adjust said guard structure with respect to said at least one cutting edge upon manual operation of said slide member.

2. The razor of claim 1 wherein said guiding means comprises a rail parallel to said axis on one of said slide member and said blade seat member, and a recess parallel to said axis in the other of said slide member and said blade seat member, said parallel rail being slidably seated in said parallel recess.

3. The razor of claim 2 wherein said moving means comprises a rail angularly disposed with respect to said axis on one of said slide member and said guard structure, and a recess angularly disposed with respect to said axis in one of said slide member and said guard structure, said angularly disposed rail being slidably seated in said angularly disposed recess.

4. The razor of claim 3 wherein said parallel rail is on said blade seat member, and said parallel recess is in said slide member.

5. The razor of claim 3 wherein said angularly disposed rail is on said guard structure, and said angularly disposed recess is in said slide member.

6. The razor of claim 1 wherein said guard structure, said hinging means and said blade seat member are integrally formed of plastic material.

7. The razor of claim 6 wherein said hinging means comprises a plurality of flexible webs.

8. The razor of claim 7 wherein said webs have a reduced cross-sectional portion.

9. The razor of claim 1 wherein said blade seat member is a component part of a replaceable cartridge having said at least one blade bonded therein.

10. The razor of claim 1 wherein said slide member is movable to a plurality of discrete positions.

11. An adjustable safety razor comprising:

a. a blade seat member, b. at least one blade positioned on said blade seat member, said at least one blade comprising at least one cutting edge, c. an elongated guard structure parallelly spaced forwardly of said at least one cutting edge, d. means for hinging said guard structure to said blade seat member, said hinging means defining an axis parallel to said guard structure, e. a manually operable slide member, f. means slidably interconnecting said slide member and said guard structure for guiding said slide member in a direction parallel to said axis, and g. means slidably interconnecting said slide member and said blade seat member in an angular direction with respect to said axis for moving said guard structure about said axis to adjust said guard structure with respect to said at least one cutting edge upon manual operation of said slide member.

12. The razor of claim 11 wherein said blade seat member is a component part of a replaceable cartridge having said at least one blade bonded therein.

* * * * *